US007647905B2

(12) United States Patent
Weber

(10) Patent No.: US 7,647,905 B2
(45) Date of Patent: Jan. 19, 2010

(54) DEVICE FOR THE VARIABLE SETTING OF THE CONTROL TIMES OF GAS EXCHANGE VALVES OF AN INTERNAL COMBUSTION ENGINE

(75) Inventor: Jürgen Weber, Erlangen (DE)

(73) Assignee: Schaeffler KG, Herzogenaurach (DE)

( * ) Notice: Subject to any disclaimer, the term of this patent is extended or adjusted under 35 U.S.C. 154(b) by 143 days.

(21) Appl. No.: 11/918,334

(22) PCT Filed: Mar. 20, 2006

(86) PCT No.: PCT/EP2006/002516

§ 371 (c)(1),
(2), (4) Date: Oct. 11, 2007

(87) PCT Pub. No.: WO2006/108494

PCT Pub. Date: Oct. 19, 2006

(65) Prior Publication Data

US 2009/0038569 A1 Feb. 12, 2009

(30) Foreign Application Priority Data

Apr. 15, 2005 (DE) ..... 10 2005 017 435

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 4,153,492 A * 5/1979 Sack et al. ..... 156/172
2002/0069844 A1* 6/2002 Kinugawa et al. ..... 123/90.17
2003/0144400 A1* 7/2003 Osen et al. ..... 524/432

FOREIGN PATENT DOCUMENTS

DE 1 237 856 3/1967

(Continued)

*Primary Examiner*—Zelalem Eshete
(74) *Attorney, Agent, or Firm*—Charles A. Muserlian

(57) ABSTRACT

A device for the variable setting of the control times of gas exchange valves of an internal combustion engine, having an inner rotor (3) and an outer rotor (4), with one of the components being rotationally fixedly connected to the camshaft (2) and the other component being drive-connected to a crankshaft, the outer rotor (4) being rotatably mounted on the inner rotor (3) and, at least one hydraulic chamber (7), which is delimited by side walls (5, 6) and the inner rotor (3), is formed on the outer rotor (4), the inner rotor (3) comprises a hub part (3*b*) and at least one vane (3*a*), with a vane (3*a*) of the inner rotor (3) extending into each hydraulic chamber (7) and dividing the latter into two pressure chambers (10, 11) which act counter to one another. A groove (8) is formed on a face, which faces toward the other component, of the inner rotor (3) or of the outer rotor (4), in which groove (8) is arranged a sealing strip (9), and with a spring element (13) being arranged between a groove base (12) of the groove (8) and the sealing strip (9), which spring element (13) forces the sealing strip (9) in the direction of an opposing face of the other component with the spring element (13) simultaneously being designed as a sealing element.

7 Claims, 6 Drawing Sheets

FOREIGN PATENT DOCUMENTS

| | | | |
|---|---|---|---|
| DE | 24 44 278 | A1 | 3/1975 |
| DE | 43 26 627 | A1 | 2/1995 |
| DE | 43 39 527 | C1 | 2/1995 |
| DE | 196 11 607 | A1 | 9/1997 |
| DE | 197 40 215 | A1 | 3/1998 |
| DE | 199 14 047 | A1 | 9/2000 |
| DE | 197 81 754 | C1 | 2/2001 |
| DE | 100 20 120 | A1 | 10/2001 |
| DE | 102 42 765 | A1 | 3/2004 |
| EP | 0 974 738 | B1 | 8/2004 |
| EP | 1 593 850 | A3 | 6/2006 |
| JP | 2001 182511 | A | 7/2001 |
| JP | 2002 256823 | A | 9/2002 |
| JP | 2002256823 | A | 9/2002 |

* cited by examiner

DEVICE FOR THE VARIABLE SETTING OF THE CONTROL TIMES OF GAS EXCHANGE VALVES OF AN INTERNAL COMBUSTION ENGINE

This application is a 371 of PCT/EP2006/002516 filed Mar. 20, 2006.

FIELD OF THE INVENTION

The invention relates to a device for the variable setting of the control times of gas exchange valves of an internal combustion engine, having an inner rotor and an outer rotor, with one of the components being rotationally fixedly connected to the camshaft and the other component being drive-connected to a crankshaft, with the outer rotor being rotatably mounted on the inner rotor and at least one hydraulic chamber, which is delimited by side walls and the inner rotor, being formed on the outer rotor, with the inner rotor having a hub part and at least one vane, with a vane of the inner rotor extending into each hydraulic chamber and dividing the latter into two pressure chambers which act counter to one another, a groove being formed on a face, which faces toward the other component, of the inner rotor or of the outer rotor, in which groove is arranged a sealing strip, and with a spring element being arranged between a groove base of the groove and the sealing strip, which spring element forces the sealing strip in the direction of an opposing face of the other component.

BACKGROUND OF THE INVENTION

Devices of said type are sufficiently well known in the prior art. For example, U.S. Pat. No. 6,484,678 B2 describes a solution in which an inner rotor is screwed by means of a central screw to the camshaft of the internal combustion engine. The outer rotor is operatively connected by means of a chain or by means of a toothed belt to the crankshaft, and is mounted on the inner rotor so as to be rotatable with respect to the latter. In addition, the outer rotor is provided with cheeks which are spaced apart in the peripheral direction and which extend inward from a radially inner peripheral face of the outer rotor. The radially inner delimiting faces of the cheeks bear against the inner rotor and therefore serve as bearing faces. In addition, the cheeks serve to define recesses on the outer rotor, which recesses are closed off in a pressure-tight manner by means of the inner rotor and two side walls and therefore serve as hydraulic chambers. A relative rotational movement can—in a manner controlled by means of an external hydraulic load—be initiated between the inner rotor and the outer rotor. For this purpose, the inner rotor is embodied as a vane wheel which is composed of a hub part and vanes which are formed in one piece with said hub. The vanes adjoin the outer peripheral face of the hub part and extend outward in the radial direction. In addition, each vane engages into a hydraulic chamber and divides the latter into two pressure chambers which act counter to one another. By means of corresponding loading of the respective pressure chamber, it is possible for an adjustment of the inner rotor relative to the outer rotor to take place between an "early stop" and a "late stop".

A further embodiment of devices of said type is described for example in DE 198 08 618 A1, in DE 199 51 391 A1 and in DE 102 53 496 A1. Here, in contrast to the first embodiment the vane(s) and the hub part of the inner rotor are produced separately. The vanes are arranged in vane grooves which are formed on the outer lateral surface of the hub part. In each case one vane divides a hydraulic chamber into two pressure chambers which act counter to one another. By means of corresponding loading of the respective section of the hydraulic chamber, it is possible for an adjustment of the inner rotor relative to the outer rotor to take place between an "early stop" and a "late stop". As an alternative to said embodiment, it is likewise possible to form the vane grooves into an inner lateral surface of the outer rotor, and to arrange the vanes there.

In order to ensure that the vanes are pressed radially outward against the radially outer end of the hydraulic chamber, in order to thereby sealingly delimit the two sections of the hydraulic chamber by means of the vane, it is known from DE 199 63 094 A1, from DE 198 08 619 A1 and from DE 199 14 047 A1 to arrange a leaf spring element in the vane groove base of the vane grooves which support the vanes, which leaf spring element exerts a radially outwardly aligned force on the vanes.

One problem of said devices is the fact that relatively high leakage flows flow between the pressure chambers of a hydraulic chamber or opposing pressure chambers of adjacent hydraulic chambers. Here, the oil passes from the oil chamber in which the higher pressure prevails to the respective pressure chamber in which the lower pressure prevails via the gap between the vane and the outer rotor or via the gap between the inner rotor and the outer rotor in the region of the bearing points.

Although a reduction in size of the gaps leads to a reduced degree of leakage, it brings with it increased friction and increased production costs on account of narrower tolerances and therefore higher production expenditure.

A solution to said problem is described in U.S. Pat. No. 6,484,678. Radial grooves which run substantially in the axial direction are formed on the radially outer face of the vanes and in the region of the bearing faces of the outer rotor. Arranged in the grooves are sealing strips which are pressed by means of spring elements against the opposing face of the in each case other component. The spring elements are supported at one side on the groove base of the grooves and at the other side against the sealing strip. The gaps between the inner rotor and the outer rotor are therefore closed off, and the leakage is reduced.

Although it is already possible with a solution of said type to obtain a good efficiency of the arrangement, leakage losses, like before, represent a problem of such devices. Said leakage is caused inter alia in that hydraulic fluid infiltrates from the one pressure chamber into the groove which supports the sealing strip, and passes via the groove base to the other pressure chamber. Especially in applications in which high reaction torques act on the camshaft, said leakage paths lead to unstable phase positions between the camshaft and the crankshaft.

The leakage behaviour is an important quality criterion of a device of said type, since this co-determines the size, that is to say the installation space and the weight, of the adjuster, and as a result also influences the design of the valves, oil pumps etc.

A disadvantage of the previously known solutions is that, in the central position of the phase position, an increased degree of leakage occurs in the groove; the sealing strip is subjected there to an alternating pressure loading between the two regions of the hydraulic chamber. This generates an alternating tilting movement of the sealing strip in the groove, which can lead to increased leakage. In the case in particular of a plurality of hydraulic chambers and vanes, the leakage losses add up here to a considerable order of magnitude.

Although the reduction in the internal leakage can be obtained by means of narrower tolerancing of the grooves and sealing strips or by means of higher friction coefficients in the leakage gap, the production accuracy required here however results in considerably higher production costs, for which reason this is no practicable approach for significantly improving the leakage behaviour, in particular the internal leakage behaviour, of the adjuster. Costs are also driven up by additional sealing elements which also disadvantageously increase the weight of the adjuster.

OBJECT OF THE INVENTION

The present invention is therefore based on the object of further developing a device of the type specified in the introduction in such a way that in particular the internal leakage losses are reduced. Here, the production costs of the adjuster should however not be increased or not be significantly increased. In addition, the adjuster should not be made heavier by the provided measures. The proposed measures should not adversely affect the assembly of the adjuster. It is also important that the solution to be proposed is service-free, as a result of which the maintenance costs of the adjuster should not be adversely affected. There should be a resulting increased efficiency of the adjuster overall, without other factors such as weight or production costs being adversely affected.

SUMMARY OF THE INVENTION

The achievement of said object by means of the invention is characterized in that the spring element is simultaneously designed as a sealing element and at least largely prevents a flow of hydraulic fluid from the one side face of the sealing strip via the groove base to the other side face of the sealing strip.

In this way, a sealing barrier for hydraulic fluid is created, which barrier extends over the entire radial extent of the gap between the groove base and the radially inner end side of the sealing strip, with the number of individual parts and therefore the assembly expenditure not being increased.

In one physical embodiment of the invention, it is proposed that the groove is formed on a bearing face of the outer rotor, by means of which bearing face the outer rotor is mounted on the inner rotor, and the sealing strip and the spring element are arranged in said groove. In this way, the leakage flow between adjacent pressure chambers of adjacent hydraulic chambers is effectively prevented.

Here, the use of the sealing strips and of the spring elements which are embodied as sealing elements is conceivable both in embodiments in which the inner rotor is composed of a hub part and vanes which are produced separately from the hub part, and also in devices in which the vane(s) are formed in one piece with the hub part.

It can also be provided that the vane is formed in one piece with the hub part, that the groove is formed on a radially outer region of the vane, and that the sealing strip and the spring element are arranged in said groove. Pressure chambers, which act counter to one another, of one hydraulic chamber are sealed off with respect to one another in this way.

Also conceivable are of course embodiments in which sealing strips are provided both between the vanes and the outer rotor and also between the hub part of the inner rotor and the outer rotor, with the sealing strips being forced against the in each case opposing component by means of spring elements which are embodied as sealing elements.

In one physical embodiment of the invention, it is provided that the spring element has at least two sealing edges or faces which bear sealingly against the radially inner end side of the sealing strip and against the groove base.

The spring element preferably has a constant cross section in a section perpendicular to the rotational axis of the inner rotor along the axis direction. The spring element can additionally extend in the axial direction substantially over the entire width of the sealing strip or of the groove base.

The spring element bears, with at least one sealing edge or face, preferably with both sealing edges or faces, areally against the radially inner end side of the sealing strip and/or against the groove base.

According to one embodiment of the invention, the spring element can be fixedly arranged on the radially inner end side of the sealing strip, that is to say the spring element and sealing strip then form a modular unit. Here, the spring element can be adhesively bonded to the radially inner end side of the sealing strip. It is also possible for the spring element to be vulcanized onto the radially inner end side of the sealing strip.

A further embodiment provides that the groove, in its groove base, has a greater width than corresponds to the width of the groove in the region in which the sealing strip is guided. Here, the spring element preferably has, with its section which is arranged in the groove base, a width which is adapted to the width of the groove base.

The spring element can have for example a T-shaped, a double-T-shaped or a Z-shaped configuration in a section perpendicular to the rotational axis of the inner rotor. Likewise conceivable is a circular, elliptical or rectangular configuration in the section perpendicular to the rotational axis of the rotor.

The spring element can be composed of metal, in particular of spring steel. Alternatively possible as a material is also plastic, for example a silicone elastomer. The metal can be at least partially coated with or encased by a coating material. Here, preferably a thermoplastic or duroplastic or an elastomer is used as a coating material.

The spring element can be of single-piece design or can be composed of a plurality of parts.

The solution proposed gives rise to the following advantages:

Internal leakages in the adjuster are considerably reduced. The leakage oil flow from the one vane side to the other vane side via the groove base and between adjoining pressure chambers of adjacent hydraulic chambers is largely eliminated. This increases the efficiency of the adjuster. In particular, a leakage loss in the central position of the sealing strip in its groove is significantly reduced; said loss can be reduced by up to 90%.

By means of the proposal according to the invention, this takes place in a very simple manner in terms of production, such that the implementation of the invention does not generate any significant additional costs. In contrast, costs can be reduced if other measures for reducing leakage are dispensed with. It is specifically possible to dispense with very close tolerancing of the inner rotor and of the outer rotor and also of the sealing strip and of the grooves which hold said sealing strip, since impermeability is ensured by means of the proposed measures even in the case of relatively large tolerances.

The assembly of the adjuster and specifically the introduction of the spring element according to the invention which is provided with sealing edges or faces is possible in a very simple and therefore cost-effective manner. Here, simplifications can be obtained during the assembly of the adjuster; the insertion of the proposed spring element into the groove can take place more simply than is the case in previously known solutions.

Servicing of the elements according to the invention is not required, such that there are no increased costs in this respect. The proposed solution also operates absolutely reliably without any servicing measures.

The weight of the adjuster is practically not increased in comparison with previously known solutions. Said weight can even be reduced if, as a result of the invention, more complex and heavier solutions, such as for example sealing elements in addition to the spring elements, are dispensed with.

The overall dimensions of the adjuster are not changed by the proposal according to the invention, such that the installation space of the adjuster remains unchanged. An implementation of the proposed solution in series production is easily possible.

BRIEF DESCRIPTION OF THE DRAWINGS

The drawings illustrate exemplary embodiments of the invention. In the drawings.

DETAILED DESCRIPTION OF THE DRAWINGS

Figure 1:
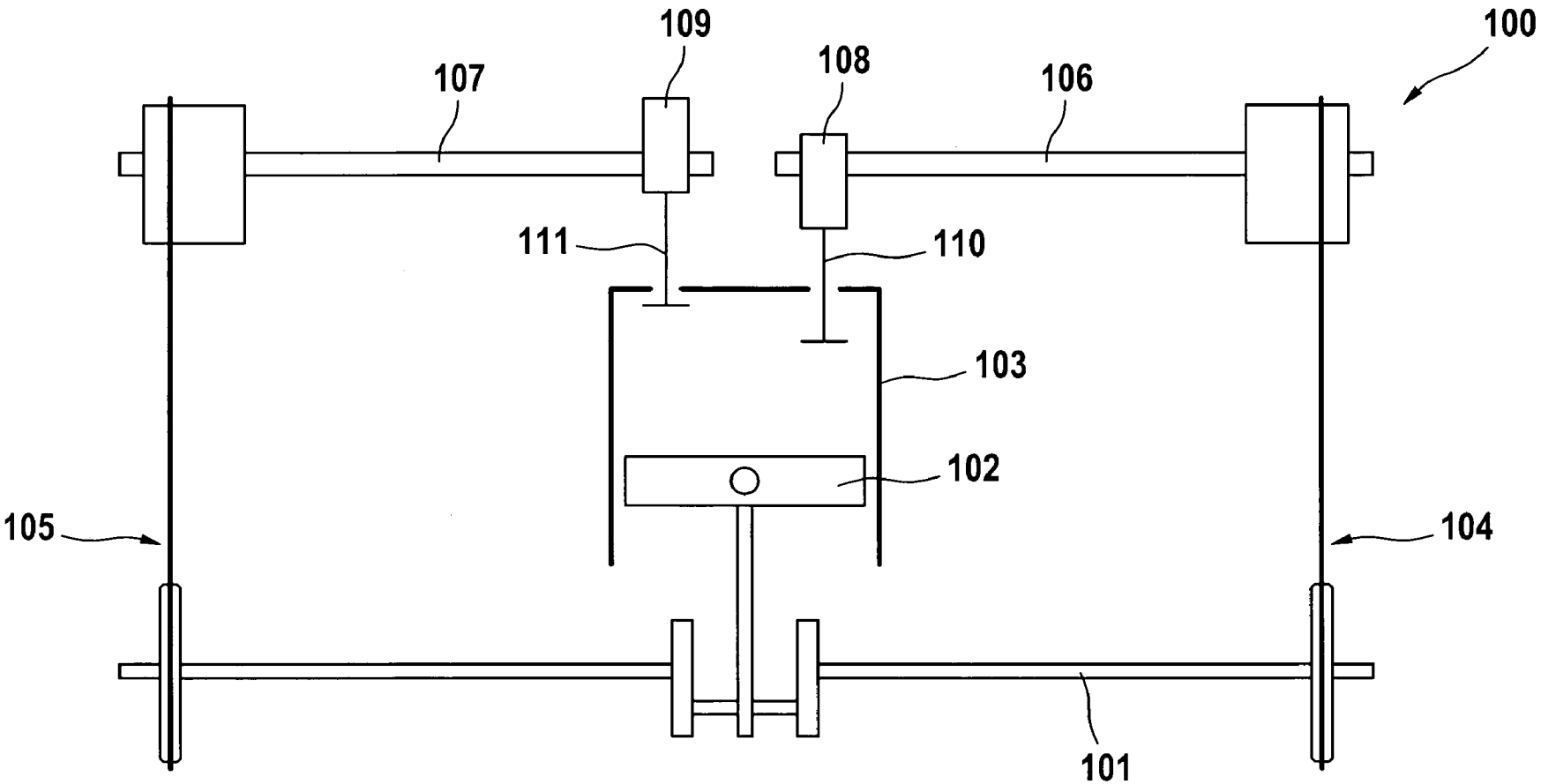
FIG. 1 shows an internal combustion engine, only schematically.

FIG. 1 shows an internal combustion engine 100, with a piston 102 which is seated on a crankshaft 101 being indicated in a cylinder 103. In the illustrated embodiment, the crankshaft 101 is connected by means of in each case one traction mechanism drive 104 or 105 to an inlet camshaft 106 or outlet camshaft 107, wherein a first and a second device 1 can serve to provide a relative rotation between the crankshaft 101 and camshafts 106, 107. Cams 108, 109 of the camshafts 106, 107 actuate an inlet gas exchange valve 110 or the outlet gas exchange valve 111.

Figure 1A:
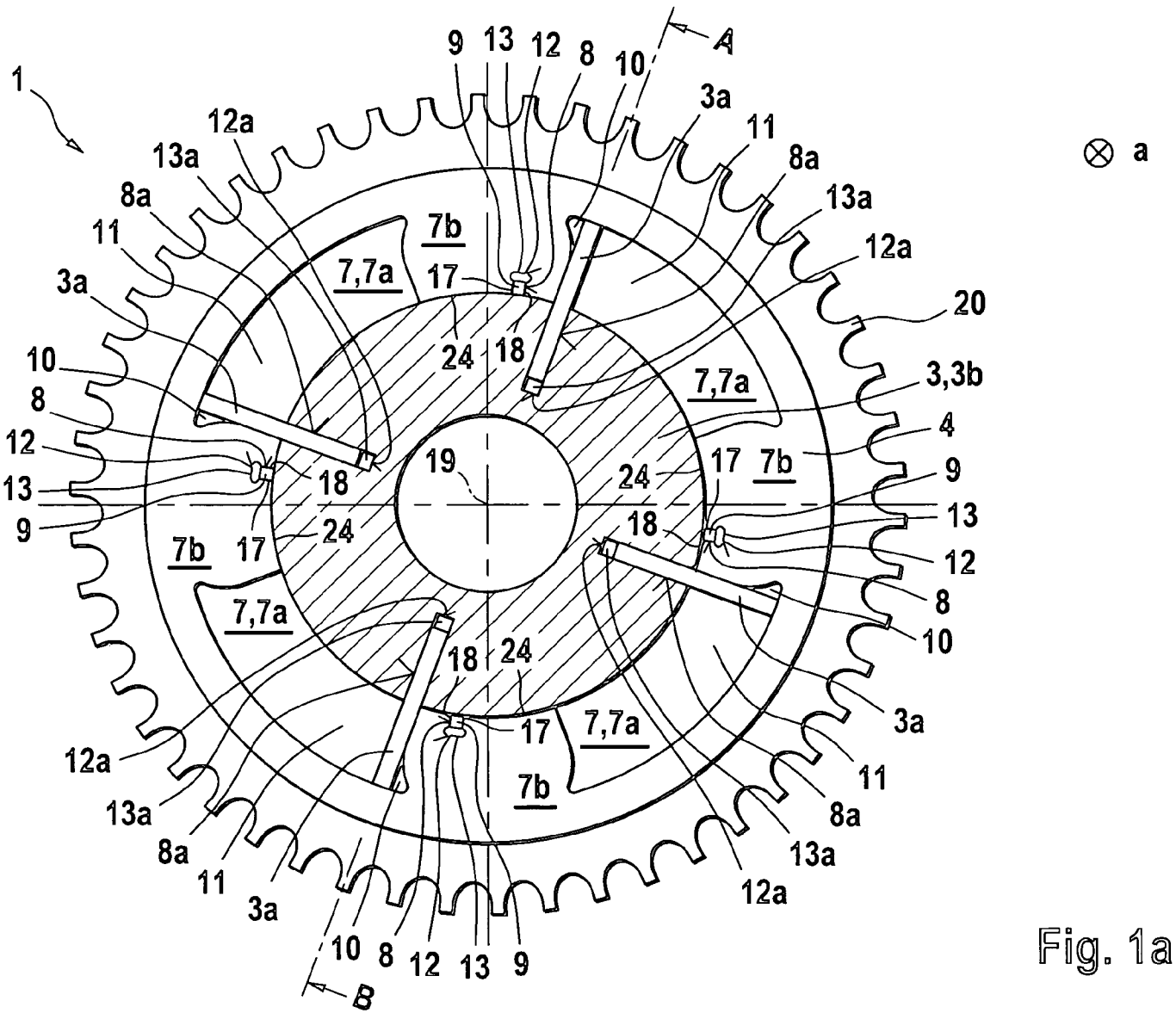
FIG. 1*a* shows a cross section through a device according to the invention along the line C-D in FIG. 1*b*, illustrated without auxiliary units.
Figure 1B:
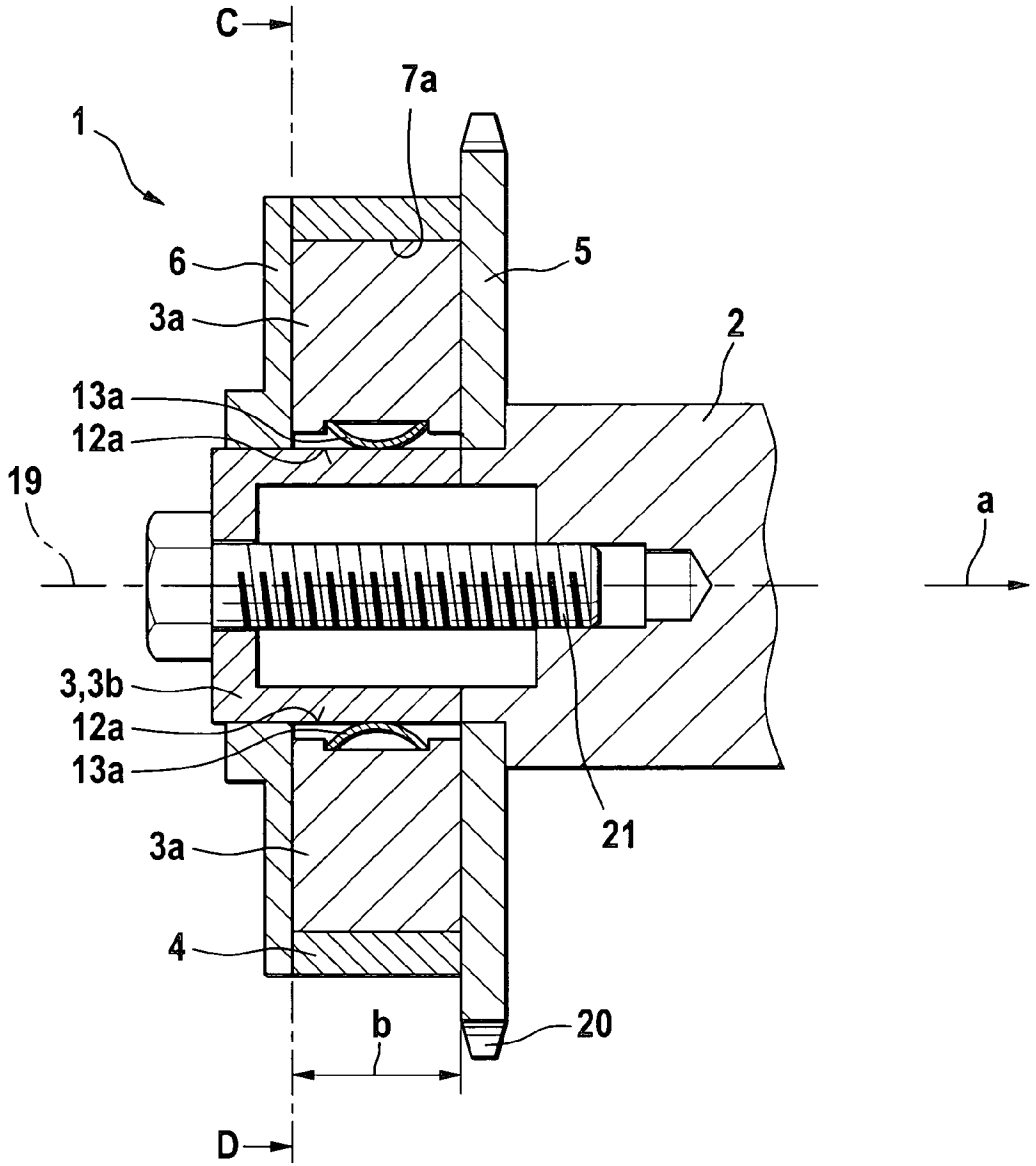
FIG. 1*b* shows a longitudinal section through the device from FIG. 1*a* along the line A-B.

FIGS. 1*a* and 1*b* illustrate, only schematically, a device 1 for the variable setting of the control times of gas exchange valves of an internal combustion engine. The device 1 has an inner rotor 3 and an outer rotor 4 which can be set relative to one another between two end positions by means of a hydraulic adjusting mechanism (not illustrated). Reference is made by way of example to DE 101 35 146 A1, which explains the conventional mode of operation of a device of said type.

A chain (not illustrated) serves to produce an operative connection between a crankshaft of the internal combustion engine and a drive wheel 20 which is embodied as a sprocket and which is rotationally fixedly connected to the outer rotor 4 and whose body simultaneously forms a first side wall 5. The adjusting mechanism (not illustrated) produces a relative rotational position between the outer rotor 4 and the inner rotor 3. The inner rotor 3 is rotationally fixedly connected by means of a central screw 21 to a camshaft 2 of the internal combustion engine. The adjuster 1 rotates about the rotational axis 19.

In the exemplary embodiment, the outer rotor 4 has formed in it four recesses 7*a* which are separated from one another by cheeks 7*b* and form hydraulic chambers 7. Said hydraulic chambers 7 are—see FIG. 1*b*—delimited at one side by the already-mentioned side wall 5 and at the other side by a second side wall 6.

In the exemplary embodiment, four vane grooves 8*a* are formed in a hub part 3*b* of the inner rotor 3, which vane grooves 8*b* extend in the present case radially and in the axial direction a. Inserted into each vane groove 8*a* is a vane 3*a*. The vane 3*a* extends, in its assembled state, radially up to the outer radial delimitation of the hydraulic chamber 7. In this way, the hydraulic chamber 7 is divided into two pressure chambers 10 and 11, which are in each case connected—not illustrated in any more detail—to hydraulic lines, by means of which hydraulic fluid can be introduced into the pressure chambers 10, 11. As viewed in the axial direction a, the vane 3*a* extends over a width b which corresponds to the width of the outer rotor 4 (see FIG. 1*b*).

In order that the vane 3*a* bears sealingly against the outer radial delimiting face of the hydraulic chamber 7, a leaf spring element 13*a* is arranged in the region of the vane groove base 12*a*, as is known in the prior art.

The outer rotor 4 is mounted on the inner rotor 3 so as to be rotatable with respect to the latter by means of bearing faces 24 which are formed on the cheeks 7*b*. In order to prevent leakage losses between adjacent pressure chambers 10, 11 of adjoining hydraulic chambers 7 as a result of an oil flow along a gap in the region of the bearing faces 24, in each case one groove 8 is formed on the outer rotor 4 in the region of the bearing faces 24, in which groove 8 is arranged a sealing strip 9. The sealing strip 9 is forced by means of a spring element 13 in the direction of the inner rotor 3. Here, the spring element 13 is arranged within the groove 8 and is supported on the one hand on a groove base 12 of the groove 8 and on the other hand on the sealing strip 9. In order to prevent leakage flows via the groove base 12 from the one pressure chamber 10, 11 to the other pressure chamber 10, 11, the spring element 13 is embodied as a sealing spring element. In the exemplary embodiment, the spring element 13 is provided with two sealing edges or sealing faces 14 and 15. The sealing edges or faces 14, 15 bear sealingly on the one hand against the radially inner end side 16 of the sealing strip 9 and on the other hand against the groove base, and thus prevent a flow of hydraulic fluid from the one side face 17, 18 of the sealing strip 9 via the groove base 12 to the other side face 17, 18 of the sealing strip 9.

In a section perpendicular with respect to the rotational axis 19, the spring element 13 has a constant cross section along the axis direction a. The axial extent of the spring element 13 and the sealing strip corresponds to the width b of the outer rotor 4.

Figure 2B:
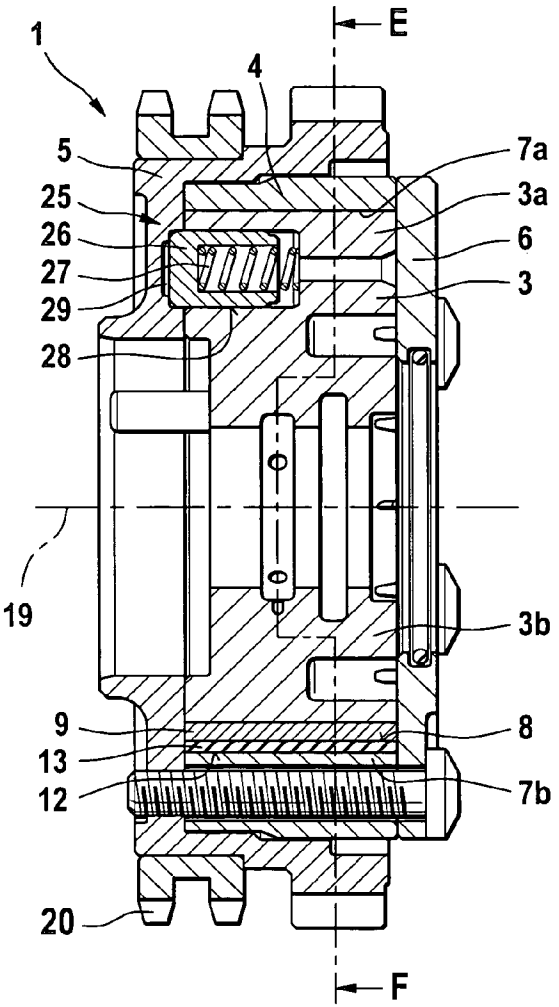
FIG. 2*b* shows a longitudinal section through the device from FIG. 2*a* along the line G-H.
Figure 2A:
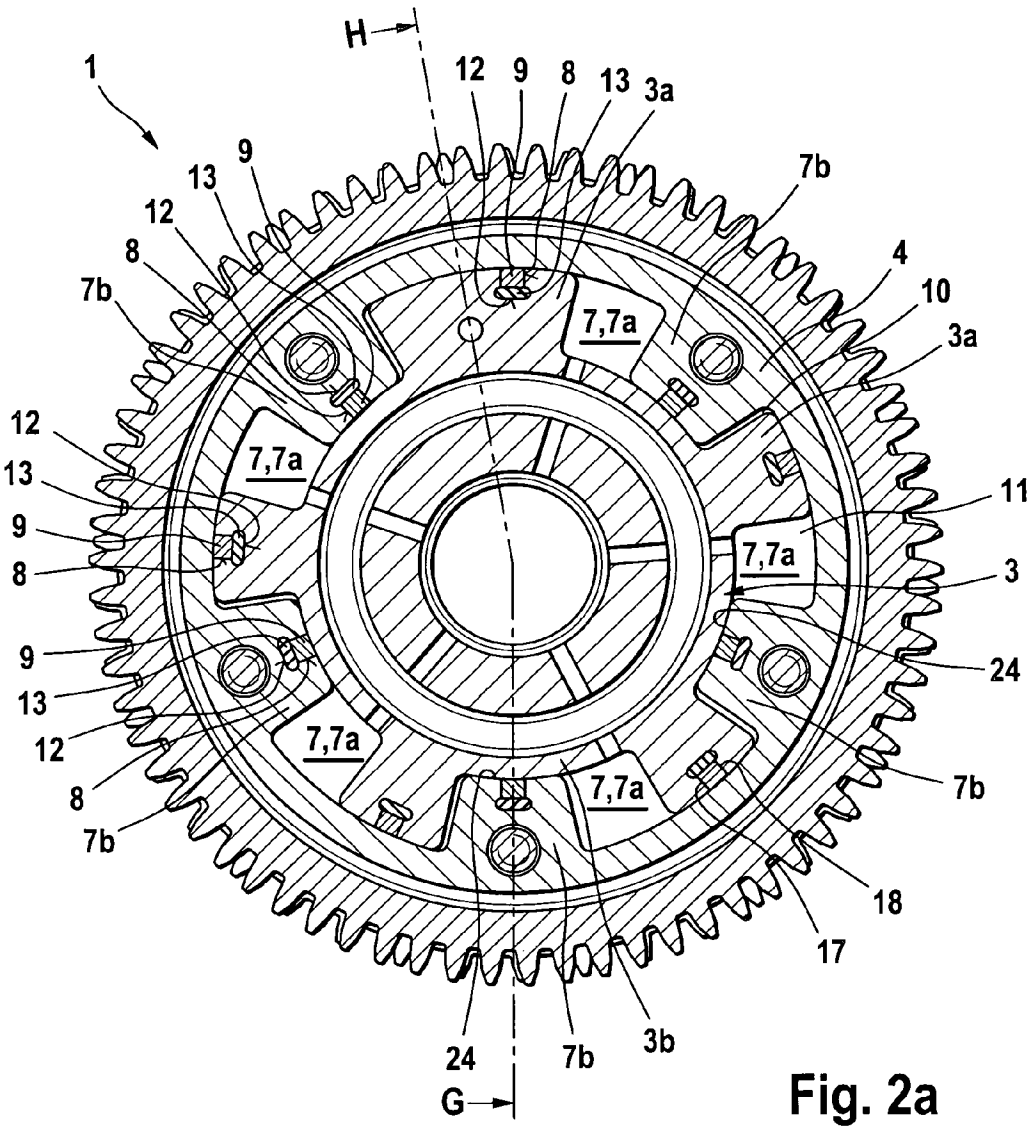
FIG. 2*a* shows a cross section through a further device according to the invention along the line E-F as per FIG. 2*b*, illustrated without auxiliary units.

FIGS. 2*a* and 2*b* show a second embodiment of a device 1 according to the invention. As in the first embodiment from FIGS. 1*a* and 1*b*, recesses 7*a* are formed on the radially inner delimiting face of the outer rotor 4, which recesses 7*a* are separated from one another by radially inwardly projecting cheeks 7*b*. The recesses 7*a* are closed off in a pressure-tight manner by side walls 5, 6 and by the inner rotor 3 and thereby form hydraulic chambers 7. In each case one vane 3*a* of the inner rotor 3 projects into each of the hydraulic chambers 7, thereby dividing the hydraulic chamber 7 into two pressure chambers 10, 11 which act counter to one another. By means of selective loading of one group of the pressure chambers 10, 11 or of both groups, it is possible to vary or hold the phase position of the inner rotor 3 relative to the outer rotor 4. In contrast to the first embodiment which is illustrated in FIGS. 1*a* and 1*b*, the hub part 3*b* and the vanes 3*a* are formed in one piece here.

In order to keep leakage flows between the pressure spaces 10, 11 of a hydraulic chamber 7 low, a radially and substantially axially running groove 8 is formed in each vane 3*a* at its radially outer face which bears against the outer rotor 4, in which groove 8 is arranged a sealing strip 9. The sealing strips 9 are forced in the direction of the outer rotor 4 by means of in each case one spring element 13 which is arranged in the groove base 12 of the groove 8. The spring element 13 is in this case likewise embodied as a spring sealing element, as a result of which leakage flows from one side face 17, 18 of the sealing strip 9 to the other side face 17, 18 via the groove base 12 are effectively prevented.

It can likewise be provided, as illustrated in FIGS. 2*a* and 2*b*, to provide in each case one or if appropriate a plurality of grooves 8 in the region of the bearing face 24 of the cheek 7*b* of the outer rotor 4, in which grooves 8 are arranged sealing strips 9 which are forced by a spring element 13 in the direction of the inner rotor 3. Said spring elements 13 are advantageously likewise designed as sealing spring elements, as a result of which the leakage flow between adjacent pressure chambers 10, 11 of adjacent hydraulic chambers 7 via the groove base 12 of the groove 8 is prevented. It would likewise be conceivable to arrange the sealing strip 9 in grooves which are formed in the inner rotor 3. Here, it is to be ensured that the sealing strip 9 is situated in the region of the bearing face 24 in all positions of the inner rotor 3 with respect to the outer rotor 4. The use of a sealing spring element which forces the sealing strip 9 in the direction of the outer rotor 4 is also advantageous in this embodiment.

The spring elements 13 in the embodiment illustrated in FIGS. 2*a* and 2*b* can be of identical design to those of the first embodiment (FIGS. 1*a* and 1*b*).

FIGS. 2*a* and 2*b* show, in addition to the drive wheel 20 which is designed as a sprocket, a spur gear toothing by means of which a second camshaft can be driven. Said design is used for example in DOHC engines in which separate, adjacently arranged camshafts are provided for the inlet and outlet valves.

The device 1 is additionally provided with a locking mechanism 25. Said locking mechanism 25 is composed of a locking piston 26 and a spring 27 which are arranged in an axially running receptacle 28 of the inner rotor. The spring 27 forces the locking piston 26 in the direction of the first side wall 5. When the device 1 is supplied with insufficient hydraulic medium, the locking piston 26, in a certain relative position of the inner rotor 3 with respect to the outer rotor 4, engages into a cutout 29 which is formed on the first side cover 5, thereby fixing the phase position of the inner rotor 3 with respect to the outer rotor 4. During operation of the internal combustion engine, that end side of the locking piston 26 which faces toward the first side cover 5 is supplied with hydraulic medium, as a result of which said locking piston 26 is forced entirely into the receptacle 28 counter to the force of the spring 27, and the locking of the inner rotor 3 with respect to the outer rotor 4 is thereby removed.

Details of the spring element 13 can be gathered from FIGS. 3 to 8. Said figures show various embodiments of the spring element 13 and specifically of its sealing edges or sealing faces 14 and 15. The illustrations show a sealing strip 9 and the associated spring element 13 which are arranged in a vane 3*a* of the second of the second embodiment of the device 1. Similarly, however, the components can also be provided on the bearing face 24 between the inner rotor 3 and the outer rotor 4 of both embodiments of the device 1. The size of the gap between the vane upper side and the outer rotor 4 is illustrated in a greatly exaggerated manner.

Figure 5:
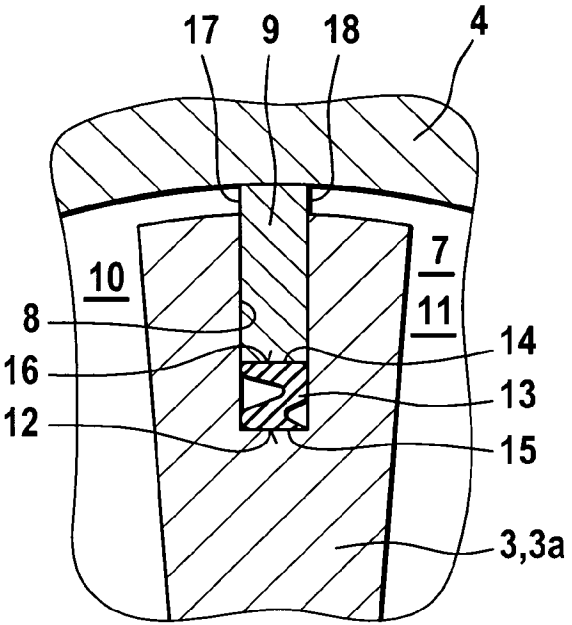
FIG. 5 shows a further alternative embodiment to FIG. 3.
Figure 4:
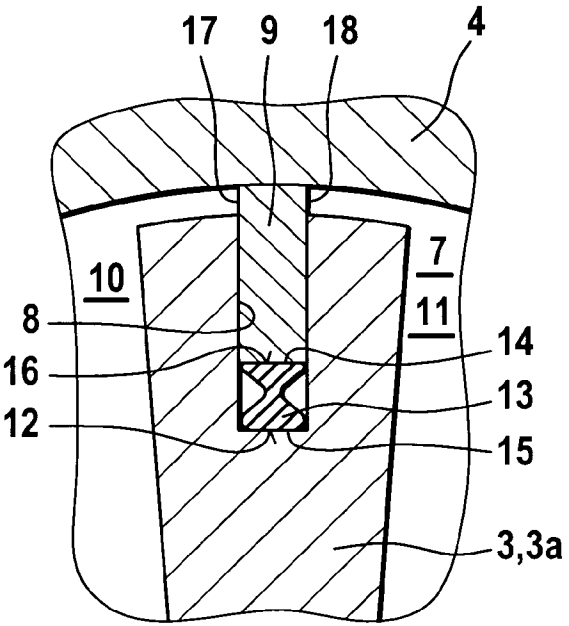
FIG. 4 shows an alternative embodiment to FIG. 3.
Figure 3:
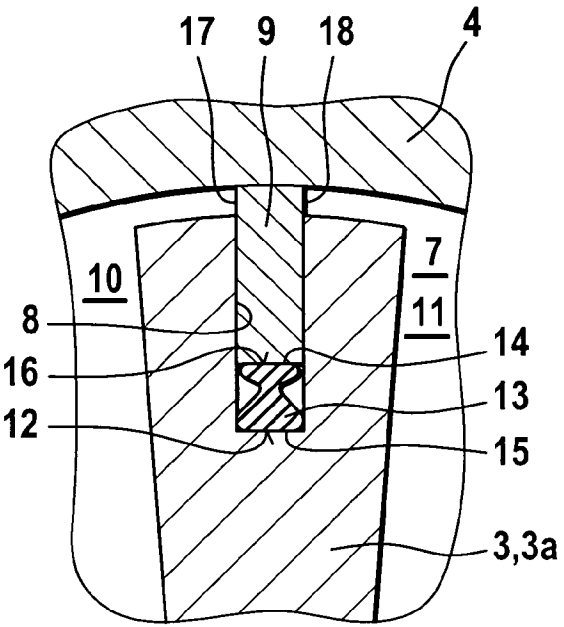
FIG. 3 is an enlarged illustration of a detail from FIG. 1*a* or 2*a*, specifically of a sealing strip in the groove which holds the latter.

The spring element 13 can have various shapes in section, various possibilities of which are illustrated in the figures. The element 13 can have an I-shape or double-T-shape in cross section (FIG. 3 and FIG. 4). Likewise possible is a Z-shape (FIG. 5). In all cases, the sealing edges or sealing faces 14 and 15 bear areally at one side against the radially inner end side 16 of the sealing strip 9 and at the other side against the groove base 12, so that an oil flow at said points is reliably prevented.

Figure 8:
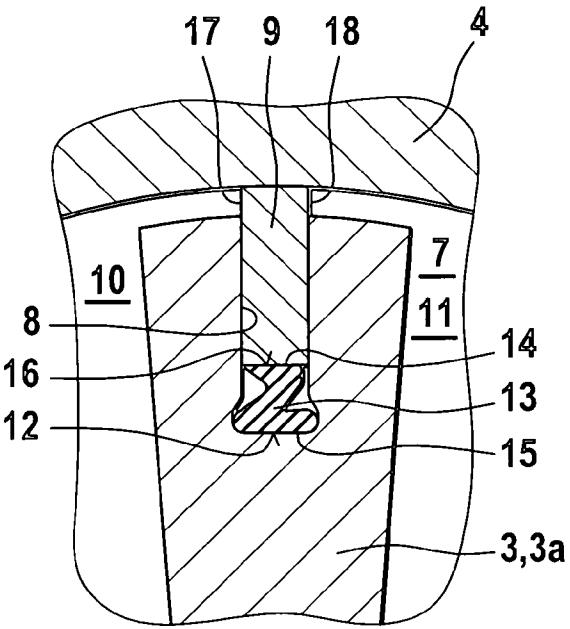
FIG. 8 shows a further alternative embodiment to FIG. 3.
Figure 7:
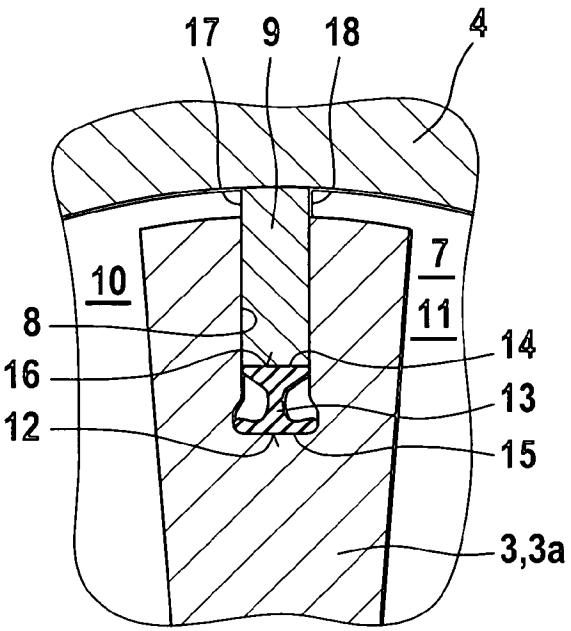
FIG. 7 shows a further alternative embodiment to FIG. 3.
Figure 6:
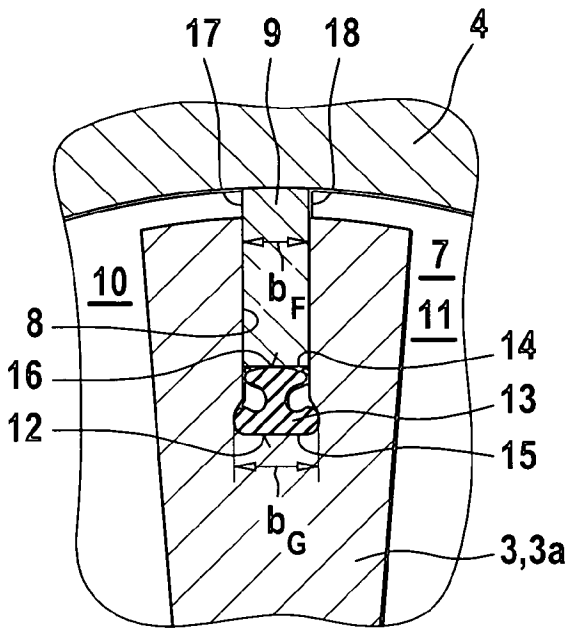
FIG. 6 shows a further alternative embodiment to FIG. 3.

In order to securely anchor the spring element 13 in the groove, the embodiment variants as per FIGS. 6 to 8 provide that the groove 8 is widened in the region of the groove base 12. As can be seen most clearly from FIG. 6, the groove 8 has, in the region of the groove base 12, a groove base width $b_G$ which is greater than the groove width $b_F$ in the region in which the sealing strip 9 is held.

FIGS. 6 to 8 again show various cross-sectional shapes of the spring element 13, specifically an I-shape or double-T-shape (FIGS. 6 and 7) and a Z-shape (FIG. 8). As can be seen, the shape of the spring element 13 and specifically of its sealing edge or sealing face 15 is adapted to the shape of the widened groove base 12.

In the exemplary embodiment, the groove 8 extends in the axial direction a; it can however also be provided that the groove 8 runs obliquely with respect to the axial direction.

The spring element 13 can—as in the exemplary embodiment—be used as a separate element which is paired with the sealing strip 9 during assembly. It can however also be provided that the spring element 13 is connected to the sealing strip 9, for example by means of adhesive bonding or by being vulcanized on.

The spring element 13 can be composed of a plurality of individual parts which are connected to one another in a suitable way, for example by means of vulcanization, by means of adhesive bonding, by means of welding or soldering etc. Said spring element can be composed of metallic or non-metallic material or of a combination of such materials. Spring steel or also sintered material can for example be considered as a metallic material. The spring element 13 can be coated with or encased by sealing material. Likewise conceivable is a spring element 13 composed of an elastic plastic, such as for example a silicone elastomer.

The spring element 13 can be produced as a continuous profile, from which pieces with the width b of the sealing strip 9 or of the groove base are cut out.

The spring element 13 can be produced and brought into its desired shape using known production methods, for example by means of primary forming (casting), by means of non-cutting shaping, by means of cutting production methods and by means of other methods such as adhesive bonding, coating, fusion etc.

LIST OF REFERENCE SYMBOLS

1 Device
2 Camshaft
3 Inner rotor
3*a* Vane
3*b* Hub part
4 Outer rotor

5 First side wall
6 Second side wall
7 Hydraulic chamber
7*a* Recess
7*b* Cheek
8 Groove
8*a* Vane groove
9 Sealing strip
10 First pressure chamber
11 Second pressure chamber
12 Groove base
12*a* Vane groove base
13 Spring element
13*a* Leaf spring element
14 Sealing edge or face
15 Sealing edge or face
16 Radially inner end side
17 First side face
18 Second side face
19 Rotational axis
20 Drive wheel
21 Central screw
24 Bearing face
25 Locking mechanism
26 Locking piston
27 Spring
28 Recess
29 Cutout
100 Internal combustion engine
101 Crankshaft
102 Piston
103 Cylinder
104 Traction mechanism drive
105 Traction mechanism drive
106 Inlet camshaft
107 Outlet camshaft
108 Cam
109 Cam
110 Inlet gas exchange valve
111 Outlet gas exchange valve
a Axial direction
b Width of the vane or of the groove base
$b_G$ Groove base width
$b_F$ Groove width

The invention claimed is:

1. A device for the variable setting of the control times of gas exchange valves of an internal combustion engine, having an inner rotor arid an outer rotor, with one of the components being rotationally fixedly connected to a camshaft and the other component being drive-connected to a crankshaft, with the outer rotor being rotably mounted on the inner rotor and at least one hydraulic chamber, which is delimited by side walls and the inner rotor, being formed on the outer rotor, with the inner rotor having a hub part and at least one vane, with a vane of the inner rotor extending into each hydraulic chamber and dividing the latter into two pressure chambers which act counter to one another, with a groove being formed on a face, which faces towards the other component of the inner rotor or of the outer rotor, in which groove is arranged a sealing strip, and with metal spring element at least partially coated with or encased by a coating material being arranged between a groove base of the groove and the scaling strip, which spring element forces the sealing strip in the direction of an opposing face of the other component, wherein the spring element is simultaneously designed as a sealing element and at least largely prevents a flow of hydraulic fluid from the one side face of the sealing strip via the groove base to the other side face of the sealing strip.

2. A device of claim 1, wherein the vane is formed in one piece with the hub part, in that the groove is formed on a radially outer region of the vane and in that the sealing strip and the spring element are arranged in said groove.

3. A device of claim 1, wherein the groove is formed on a bearing face of the outer rotor, by means of which bearing face the outer rotor is mounted on the inner rotor, and the sealing strip and the spring element are arranged in said groove.

4. A device of claim 1, wherein the spring element has at least two sealing edges or faces which bear sealingly against the radially inner end side of the sealing strip and against the groove base.

5. A device of claim 1, wherein the spring element bears, with at least one sealing edge or face, areally against a radially inner end side of the sealing strip and/or against the groove base.

6. A device of claim 1, wherein the spring element is fixedly arranged on the radially inner end side of the sealing strip.

7. A device of claim 1, wherein the coating material is an elastomer.

* * * * *